US007132921B2

(12) United States Patent
Eguchi et al.

(10) Patent No.: US 7,132,921 B2
(45) Date of Patent: Nov. 7, 2006

(54) POWER SUPPLY MODULE AND ELECTRONIC APPARATUS USING THE SAME

(75) Inventors: Susumu Eguchi, Kawasaki (JP); Hiroshi Shimamori, Kawasaki (JP); Kazuhiko Itakura, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 141 days.

(21) Appl. No.: 10/773,153

(22) Filed: Feb. 9, 2004

(65) Prior Publication Data

US 2004/0189434 A1 Sep. 30, 2004

(30) Foreign Application Priority Data

Mar. 31, 2003 (JP) ..... 2003-093880

(51) Int. Cl.
*H01F 5/00* (2006.01)

(52) U.S. Cl. ..... 336/200; 336/223; 336/232

(58) Field of Classification Search ..... 336/200, 336/232, 223
See application file for complete search history.

(56) References Cited

U.S. PATENT DOCUMENTS 5,929,733 A * 7/1999 Anzawa et al. ..... 336/61
5,990,776 A * 11/1999 Jitaru ..... 336/200
6,046,918 A * 4/2000 Jitaru ..... 363/93
6,232,562 B1 * 5/2001 Kikuchi et al. ..... 174/260
6,281,779 B1 * 8/2001 Matsumoto et al. ..... 336/200
6,380,836 B1 * 4/2002 Matsumoto et al. ..... 336/200
6,621,400 B1 * 9/2003 Horie ..... 336/200
6,664,882 B1 * 12/2003 Andoh et al. ..... 336/200
6,687,143 B1 * 2/2004 Yamamoto et al. ..... 363/126
6,757,174 B1 * 6/2004 Nagai et al. ..... 361/767
6,914,508 B1 * 7/2005 Ferencz et al. ..... 336/200
6,943,502 B1 * 9/2005 Yamanaka et al. ..... 315/224

FOREIGN PATENT DOCUMENTS

| | | |
|---|---|---|
| JP | 62-142395 | 6/1987 |
| JP | 6-163264 | 6/1994 |
| JP | 7-135117 | 5/1995 |
| JP | 8-17658 | 1/1996 |
| JP | 10-163039 | 6/1998 |

* cited by examiner

*Primary Examiner*—Anh Mai
(74) *Attorney, Agent, or Firm*—Staas & Halsey LLP

(57) ABSTRACT

To reduce pattern resistance including a secondary winding in a power supply module having a pair of secondary windings transformer-coupled with a primary winding. The pair of secondary windings coupled with a primary winding through a transformer is drawn out in both directions each other, and further disposed on different layers. Also, output pattern films are disposed on both sides of the second and third layers, so that pattern films of wide shape can be produced.

15 Claims, 8 Drawing Sheets

POWER SUPPLY MODULE AND ELECTRONIC APPARATUS USING THE SAME

CROSS-REFERENCE TO RELATED APPLICATIONS

This application is based upon and claims the benefit of priority from the prior Japanese Patent Application No. 2003-093880, filed on Mar. 31, 2003, the entire contents of which are incorporated herein by reference.

BACKGROUND OF THE INVENTION

1. Field of the Invention

The present invention relates to an on-board type power supply module for a distributed power supply system and an electronic apparatus using the same, and more particularly a power supply module for improving power supply efficiency and an electronic apparatus.

2. Description of the Related Arts

With increasing complexity of an electronic apparatus such as an information processing unit, the electronic-apparatus is required to have improved reliability. As a distributed configuration is preferably applied to the electronic apparatus to obtain improved reliability, a power supply unit having a distributed configuration is also desired for the electronic apparatus. A distributed power supply system is currently applied for a server, a storage system, etc. The distributed power supply system requires a miniaturized power supply module which can be on-board mounted on a board for electronic units installed in the server, the storage unit, etc.

FIG. 9 is a configuration diagram of a prior art transformer-coupled switching power supply circuit. A primary winding 100 and two secondary windings 110, 120 are wound around a core of a transformer T, enabling transformer coupling between the primary side and the secondary side. The primary side is provided with an FET 102, which is a primary side circuit for controlling the current flowing through the primary winding 100, and a switching control circuit 104.

Meanwhile, on the secondary side, there are provided: pairs of FETs 114, 116 and 124, 126 respectively constituting rectifier circuits which rectify the current flowing through the secondary windings 110, 120; switching control circuits 112, 122; choke coils L1, L3 and capacitors C1, C2 which constitute smoothing circuits.

As is well known, in this switching power supply, switching control circuits 112, 122 controls to switch FETs 114, 116, 124, 126 to perform rectification operation of the secondary output, and to protect from overcurrent and overvoltage. Also, switching control circuit 104 controls FET 102 to protect from overcurrent on the primary side.

In such a way, when a large electric current is required on the secondary side, two secondary circuits are provided, constituting a so-called double-current configuration.

FIG. 10 is an explanatory winding diagram in a conventional power supply module, and FIG. 11 is an exploded configuration diagram of the conventional power supply module. As can be seen from FIGS. 10, 11, there are limits of a card size, component layout, etc. when miniaturizing the power supply module. A typical power supply module is structured of five layers L1–L5.

A top surface layer L1 and a bottom surface layer L5 are component-mounting layers, while inner layers L2–L4 are provided for forming circuit patterns. The top surface layer L1 is provided an one part of a transformer T, a primary winding 100 and primary-side circuit 102, 104, FETs 114, 116, 124, 126 of the secondary side circuit, one portion of switching control circuit 112, 122 on the secondary side, one input terminal 150 and one output terminal 160.

The bottom surface layer L5 is provided another part of the transformer T, the primary winding 100 and the primary-side circuit, choke coils L1, L3 and capacitor C disposed in the secondary side circuit, the other portion of the switching control circuit 112, 122 on the secondary side, another input terminal 152 and another output terminal 162.

A first inner layer L2 is provided two secondary windings 110, 120, a wiring area 132 for the primary side circuits 102, 104 and a wiring area 130 for the secondary switching control circuits 112, 122. A second inner layer L3 is provided a pair of output pattern films P1, P3, a wiring area 136 for the primary side circuits 102, 104 and a wiring area 138 for switching control circuits 112, 122 on the secondary side. A third inner layer L4 is provided a pair of ground films G1, G3, a wiring area 138 for the primary side circuits 102, 104 and a wiring area 140 for switching control circuits 112, 122 on the secondary side.

As shown in FIG. 10, the primary winding 100, the transformer T, and the pair of the secondary windings 110, 120 are disposed on a module, from left to right on this order. Together with these components, the primary side circuits 102, 104, the secondary side circuits 114, 116, 124, 126, and L1, L3, the output pattern films P1, P3 and the ground films G1, G3 are provided.

More specifically, the pair of secondary windings 110, 120 is drawn out in the same direction. Also, the secondary side circuits 114, 116, 124, 126, and L1, L3, the output pattern films P1, P3 and the ground films G1, G3 are disposed in such a manner that each point p1, u1, q1, s1, t1, p2, u2, q2, s2, and t2 in the secondary side circuit shown in FIG. 9 may be connected between the relevant layers through vias.

Now, in recent years, a load to which power is supplied from such a power supply module requires a large electric current. For example, a high-speed CPU requires larger current than a low-speed CPU. When. outputting such large current, the resistance and inductance included in the patterns of the power supply module become hardly negligible, because a large power loss and noise may be produced.

According to the above-mentioned layout of the conventional power supply module, the pair of secondary windings 110, 120 is drawn out in single direction, as illustrated in FIG. 10. Therefore, it is difficult to obtain large cross-section areas S of the secondary windings 110, 120. Also, in order to draw in single direction, it is necessary to mount both a pair of rectifier circuits and a pair of smoothing circuits of the secondary side on single side of the transformer T. To enable via connection with these secondary side circuits, the lengths l of the secondary windings 110, 120 have to be large.

The resistance r of the secondary windings is defined as $r=\rho*l/S$, the resistance value of the secondary windings cannot be small enough when l is large. Further, because the drawing of single direction requires a pair of output pattern films and a pair of ground films to be disposed on single side of the transformer T, it is difficult to have wide output pattern films and wide ground films. Therefore, it is difficult to reduce the output resistance.

As a result, when a large current is output, a large power loss is produced, and power supply efficiency is reduced. Further, because of large pattern lengths of the secondary windings, the inductance L becomes large. In the switching power supply, sharp current variation (di/dt) is produced by the choke coil and the transformer, the produced noise is determined as L*di/dt. Accordingly, when the current becomes large, the noise produced becomes hardly negligible, and a large switching noise is produced.

Needless to say, if a size of the power supply module may be large, the resistance value and the inductance of each pattern disposed on the pattern layers L2, L3, L4 can be smaller. However, the power supply module of large size does not fit for an apparatus in which miniaturization is desired.

SUMMARY OF THE INVENTION

Accordingly, it is an object of the present invention to provide a power supply module and an electronic apparatus of limited size range, and with improved power supply efficiency.

It is another object of the present invention to provide a power supply module and an electronic apparatus which prevent from increasing the power loss, even under a large output current condition.

Further, it is still another object of the present invention to provide a power supply module and an electronic apparatus which prevent from increasing switching noise, even under a large output current condition.

In order to attain the aforementioned objects, a power supply module and an electronic apparatus in accordance with the present invention have a power supply module including a primary winding coupled with secondary windings by a transformer. The power supply module also includes: a component-mounting layer on which the primary winding, the transformer, a primary side circuit, and a secondary side circuit are mounted; a first inner layer on which a pattern of a first secondary winding drawn in one direction is formed; and a second inner layer on which a pattern of a second secondary winding of the secondary windings drawn in the other direction is formed. An output pattern film of the second secondary winding is formed on the first inner layer, and an output pattern film of the first secondary winding is formed on the second inner layer.

According to the present invention, a pair of secondary windings is drawn out in both directions, and provided on different layers. With such a structure, the secondary windings can be formed of wide and short patterns. Also, because of the drawing in both directions, the output pattern films can be disposed on both sides of a second and a third layers, enabling widened output pattern films.

With this structure, when an output current becomes large, the power loss becomes half as much as in the conventional power supply module, and thus improved power efficiency can be obtained. Further, because of the reduced inductance, switching noise can be reduced. Moreover, the module can be attained without making the module size large.

According to the present invention, preferably, the power supply module further includes a third inner layer on which a pair of ground films for the first and the second secondary windings is formed. With this structure, the ground films can be widened, and thus reduced pattern resistance can be obtained.

Also, according to the present invention, preferably, on the component-mounting layer, a secondary side circuit of the first secondary winding and a secondary side circuit of the second secondary winding are disposed on both side of the transformer. With this structure, connection to each secondary winding through vias becomes possible, and thus a miniaturized power supply module can be structured.

Further, according to the present invention, preferably, the component-mounting layer includes: a first component-mounting layer on which a rectifier circuit for the secondary side circuit of the first secondary winding is disposed on one side of the transformer and a rectifier circuit for the secondary side circuit of the second secondary winding is disposed on the other side of the transformer; and a second component-mounting layer on which a smoothing-circuit for the secondary side circuit of the first secondary winding is disposed on one side of the transformer and a smoothing circuit for the secondary side circuit of the second secondary winding is disposed on the other side of the transformer.

With this structure, connection to each secondary winding through via becomes possible, and thus a miniaturized power supply module having short pattern lengths can be structured.

Also, according to the present invention, preferably, the secondary side circuit mounted on the component-mounting layer, the first secondary winding and the output pattern film formed on the first inner layer, the second secondary winding and the output pattern film formed on the second inner layer, and the pair of ground films formed on the third inner layer are connected through via. With this structure, a miniaturized power supply module having short pattern lengths can be attained.

Still further, according to the present invention, preferably, the rectifier circuit for the secondary side circuit mounted on the component-mounting layer includes a switching element and a switching control circuit. With this structure, switching noise produced in the switching power supply can be reduced.

Further, according to the present invention, preferably, the power supply module includes an input terminal connected to the primary winding, and an output terminal connected to the output pattern film. Thus, the power supply module can be connected to a printed circuit board.

Further scopes and features of the present invention will become more apparent by the following description of the embodiments with the accompanied drawings.

DETAILED DESCRIPTION OF THE PREFERRED EMBODIMENTS

The preferred embodiment of the present invention is described hereinafter referring to the charts and drawings, on the order of a power supply module, an electronic apparatus, and other embodiments.

[Power Supply Module]

Figure 1:
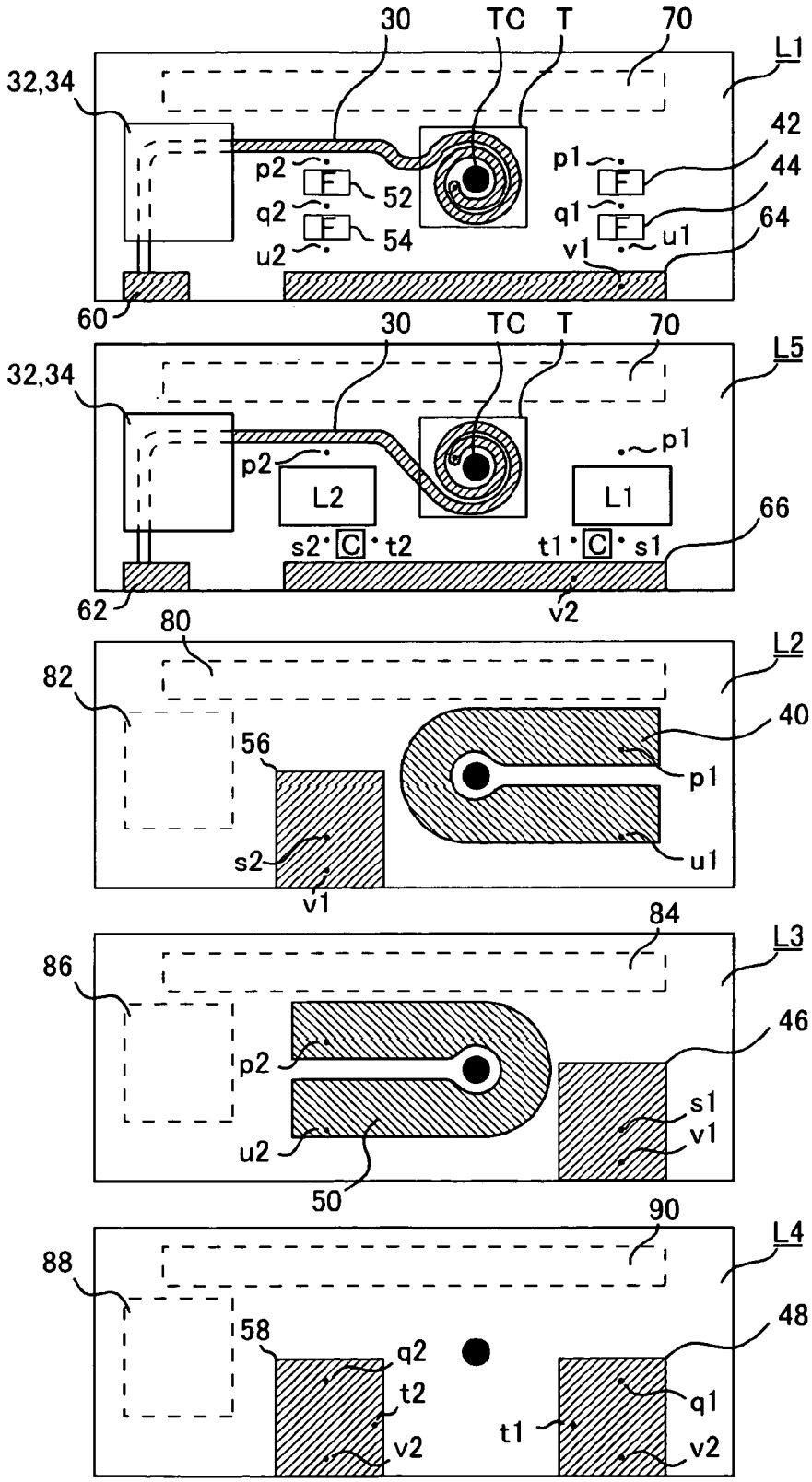
FIG. 1 shows an exploded configuration diagram of a power supply module in accordance with an embodiment of the present invention.
Figure 2:
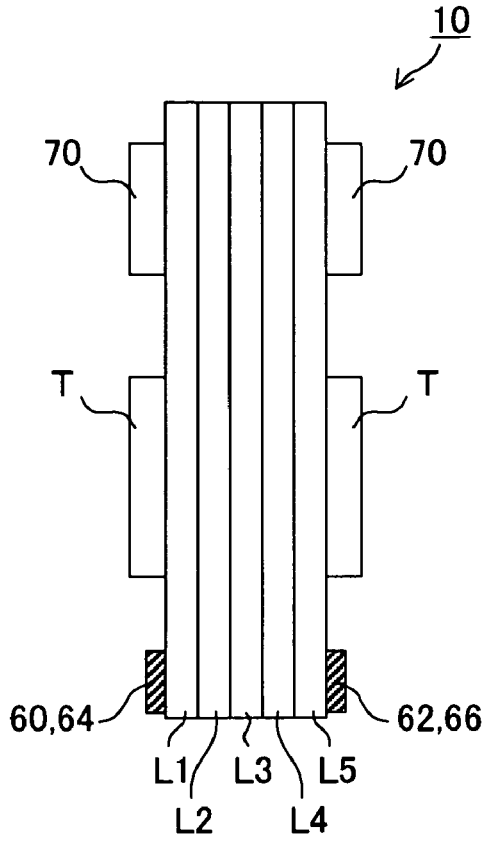
FIG. 2 shows a cross-sectional view of a power supply module in accordance with an embodiment of the present invention.
Figure 3:
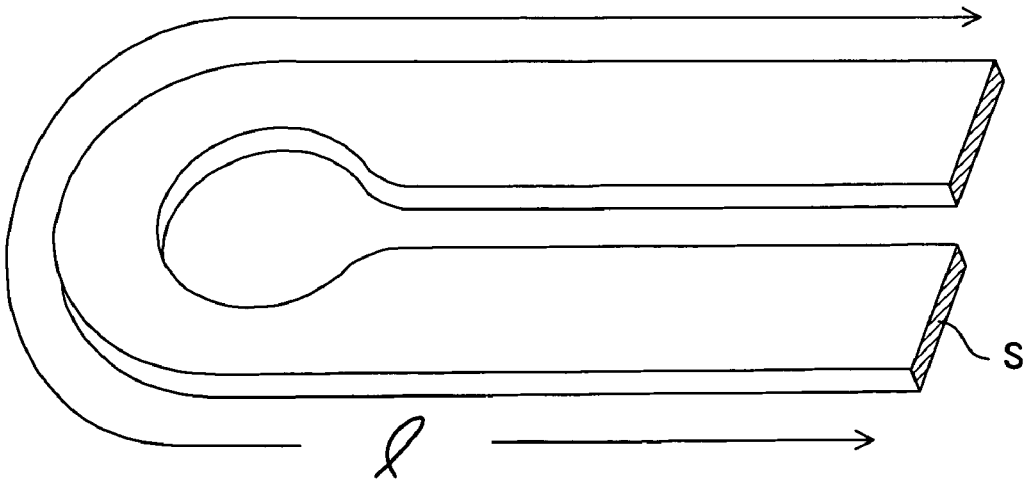
FIG. 3 shows an explanatory diagram of the secondary winding pattern shown in FIG. 1.
Figure 4:
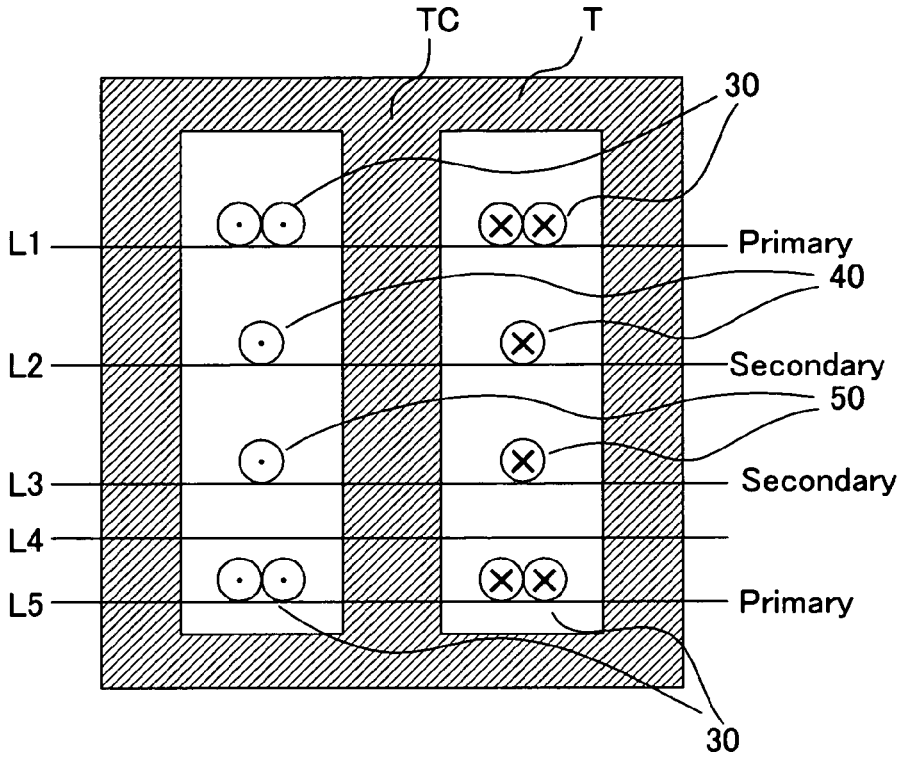
FIG. 4 shows cross-sectional views of the transformer, the primary winding, and the secondary winding shown in FIG. 1.
Figure 5:
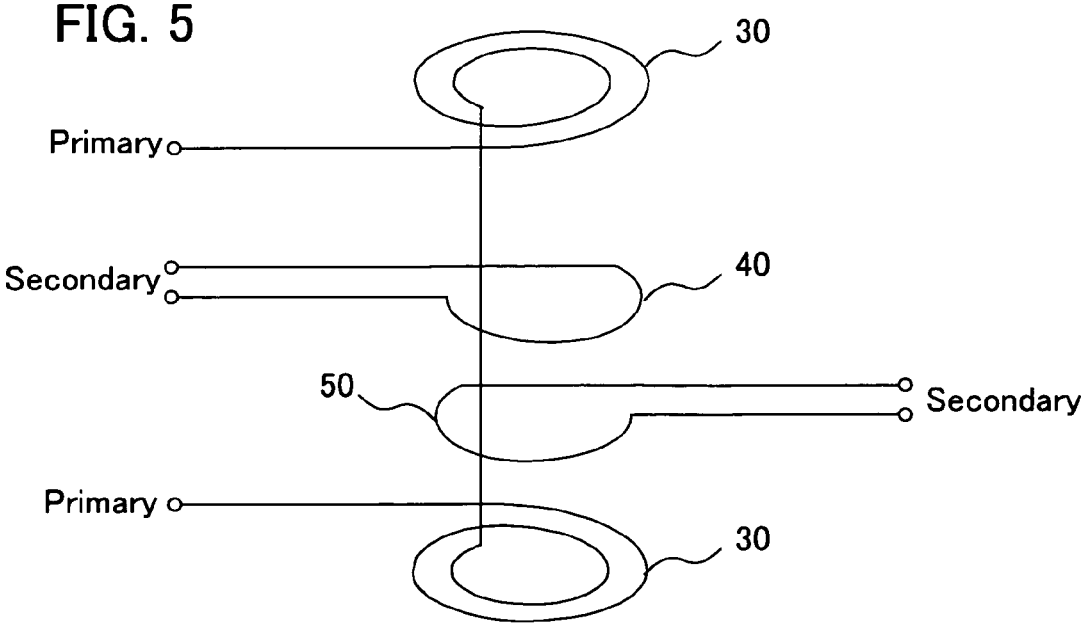
FIG. 5 shows a diagram illustrating a relation between the primary winding and the secondary winding shown in FIG. 1.
Figure 6:
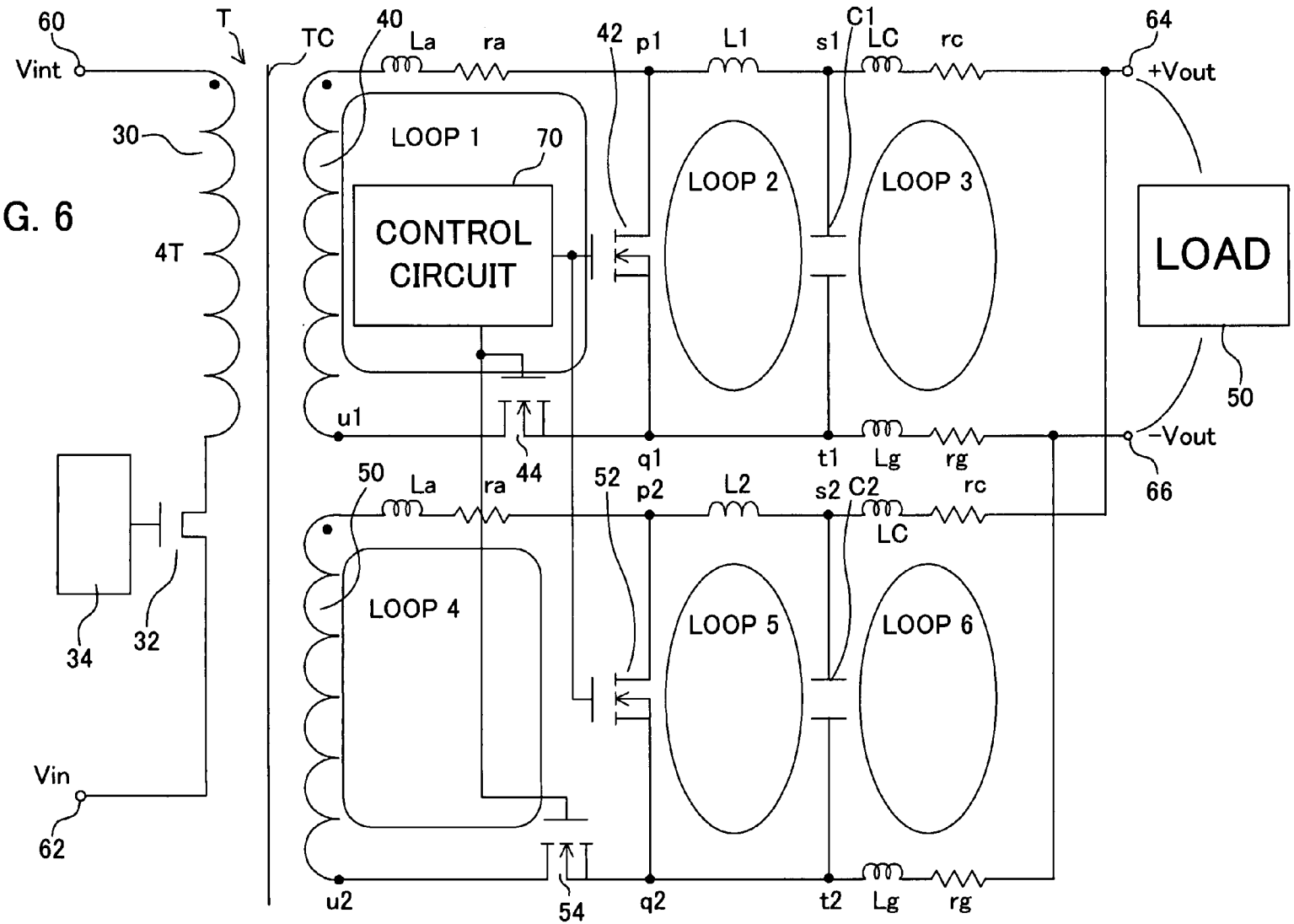
FIG. 6 shows a circuit diagram of the power supply circuit shown in FIG. 1.

FIG. 1 is a configuration diagram of each layer in a power supply module in accordance with an embodiment of the present invention. FIG. 2 is a cross-sectional view of the embodiment of the present invention. FIG. 3 is an explanatory diagram of a secondary winding pattern shown in FIG. 1. Also, FIG. 4 is a cross section of a transformer. FIG. 5 is a diagram illustrating a relation between the primary winding and the secondary winding shown in FIG. 1. And, FIG. 6 is a circuit diagram of the power supply module shown in FIG. 1.

Before explaining the layout configuration shown in FIG. 1, the circuit configuration of the power supply module of which layout configuration is shown in FIG. 1 will be described, referring to FIG. 6. The configuration diagram shown in FIG. 6 denotes a transformer-coupled switching power supply circuit, which is similar to that shown in FIG. 9. A primary winding 30 and two secondary windings 40, 50 are wound around a core of a transformer T, and thus the primary side and the secondary side are transformer coupled. On the primary side, there are provided, as a primary side circuit, an FET 32 controlling the current flowing through the primary winding 30, and a switching control circuit 34.

On the other hand, on the secondary side, there are provided: a pair of FETs 42, 44 and a pair of FETs 52, 54 constituting rectifier circuits each rectifying the current flowing through each secondary winding 40, 50; a switching control circuit 70; choke coils L1, L2 and capacitors C1, C2 constituting smoothing circuits.

As is generally known, in this switching power supply circuit, a switching control circuit 70 supervises the output voltage, and switches FETs 42, 44, 52, 54, so as to perform a rectification operation for the output on the secondary side, and to protect the secondary side from over-current and over-voltage. Also, the switching control circuit 34 controls FET 32 to protect the primary side from overcurrent.

As such, when a large electric current is required on the secondary side, there is adopted so-called a double current configuration, with the provision of two secondary side circuits.

Now, a resistance component and an inductance component respectively produced in the inner layers described earlier are illustrated in FIG. 6. In this figure, ra and La denote the resistance and the inductance of the secondary windings 40, 50; Lc and rc denote the inductance and the resistance of an output pattern film; and, Lg and rg denote the inductance and the resistance of a ground film.

As illustrated in the cross-sectional view of power supply module 10 shown in FIG. 2, this power supply module 10 is provided with five layers L1–L5. A top surface layer L1 and a bottom surface layer L5 constitute component-mounting layers, while inner layers L2–L4 constitute layers on which patterns are formed.

As shown in FIG. 1, the top surface layer L1 is provided: a transformer T; an portion of a primary winding 30; primary-side circuit portions 32, 34; FETs 42, 44, 52, 54 of the secondary side circuit; the switching control circuit portion 70 on the secondary side; one input terminal 60; and one output terminal 64.

The bottom surface layer L5 is provided: the transformer T; the primary winding 30; the other portion of the primary-side circuit portions 32, 34; choke coils L1, L2 and a pair of capacitors C which are disposed in the secondary side circuit; the other switching control circuit portions 70 on the secondary side; the other input terminal 62; and the other output terminal 66.

In a first inner layer L2, according to the present invention, there is provided a pattern 40 of a first secondary winding, which is drawn out in one direction. And, on its left, a second output pattern film 56 is disposed. Further, there are provided: a wiring area 82 for the primary side circuits 32, 34; and a wiring area 80 for the secondary-side switching control circuit 70.

In a second inner layer L3, according to the present invention, there is provided a pattern 50 of a second secondary winding, which is drawn out in the other direction than the direction of pattern 40. And, on its right, a first output pattern film 46 is disposed. Further, there are provided: a wiring area 86 for the primary side circuits 32, 34; and a wiring area 84 for the secondary-side switching control circuit 70.

In a third inner layer L4, there are provided a pair of ground films 48, 58; a wiring area 88 for the primary side circuits 32, 34; and a wiring area 90 for the secondary-side switching control circuit 70.

Accordingly, as shown in FIG. 4, in the transformer T, the primary winding 30, the first secondary winding 40, the second secondary winding 50, the ground layer L4, and the primary winding 30 are provided in that order. Namely, two secondary windings 40, 50 are disposed on different layers L2, L3. Further, the secondary winding 40 and the secondary winding 50 are drawn out in the opposite directions each other, as shown in FIG. 3.

Together with the layouts illustrated above, the primary side circuits 32, 34, and the secondary side circuits 42, 44, 52, 54, L1 and L2 are disposed. Further, the output pattern film 56 of the second secondary winding 50 is disposed on the first inner layer L2, on which the first secondary winding 40 is disposed. Also, the output pattern film 46 of the first secondary winding 40 is disposed on the second inner layer L3, on which the second secondary winding 50 is disposed. Corresponding to these layouts, the ground films 48, 58 are provided on the third inner layer L4.

Namely, two secondary windings 40, 50 are drawn out in the opposite directions each other. In order to connect, through via among the layers, points p1, u1, q1, s1, t1, p2, u2, q2, s2, and t2 on the secondary side circuit shown in FIG. 1, the rectifier circuits 42, 44 provided on the secondary side circuit are disposed on one side of the transformer T, while rectifier circuits 52, 54 provided on the secondary side circuit are disposed on the other side of the transformer T. Further, smoothing circuits L1, L2, and C are disposed separately on both sides of the transformer T.

According to the present invention, two secondary windings 40, 50 are disposed on the different layers L2, L3, respectively, so that large exclusive areas of secondary windings 40, 50 can be prepared in the vertical direction in the figure. In other words, a secondary winding pattern having a large cross section area S and a short pattern length l can be provided, as shown in FIG. 3.

As described earlier, a pattern resistance value is represented by $r=\rho*l/S$. Therefore, with the above-mentioned structure, the resistance value of the pattern can be reduced. Further, because an inductance L of the pattern is proportional to the pattern length l, the inductance can be reduced.

With such a configuration, no layer dedicatedly to the output pattern films can be provided. According to the present invention, this problem is solved by arranging the extraction of the secondary windings 40, 50 in the opposite directions each other. Namely, the output pattern film 56 of the second secondary winding 50 is provided on the first inner layer L2 having the first secondary winding 40. Also, the output pattern film 46 of the first secondary winding 40 is provided on the second inner layer L3 having the second secondary winding 50.

Because these output pattern films are provided on the different layers, it becomes possible to have a large pattern width (cross section S). This enables reduced resistance values of the output pattern films, which are derived from the formula of the pattern resistance value $r=\rho*l/S$.

Similarly, the ground films 48, 58 can be: disposed respectively on the right area and the left area of the third inner layer L4, thereby producing a large pattern width (cross section S). Thus, the pattern resistance value can be reduced, which is also derived from the pattern resistance value $r=\rho*l/S$.

Figure 9:
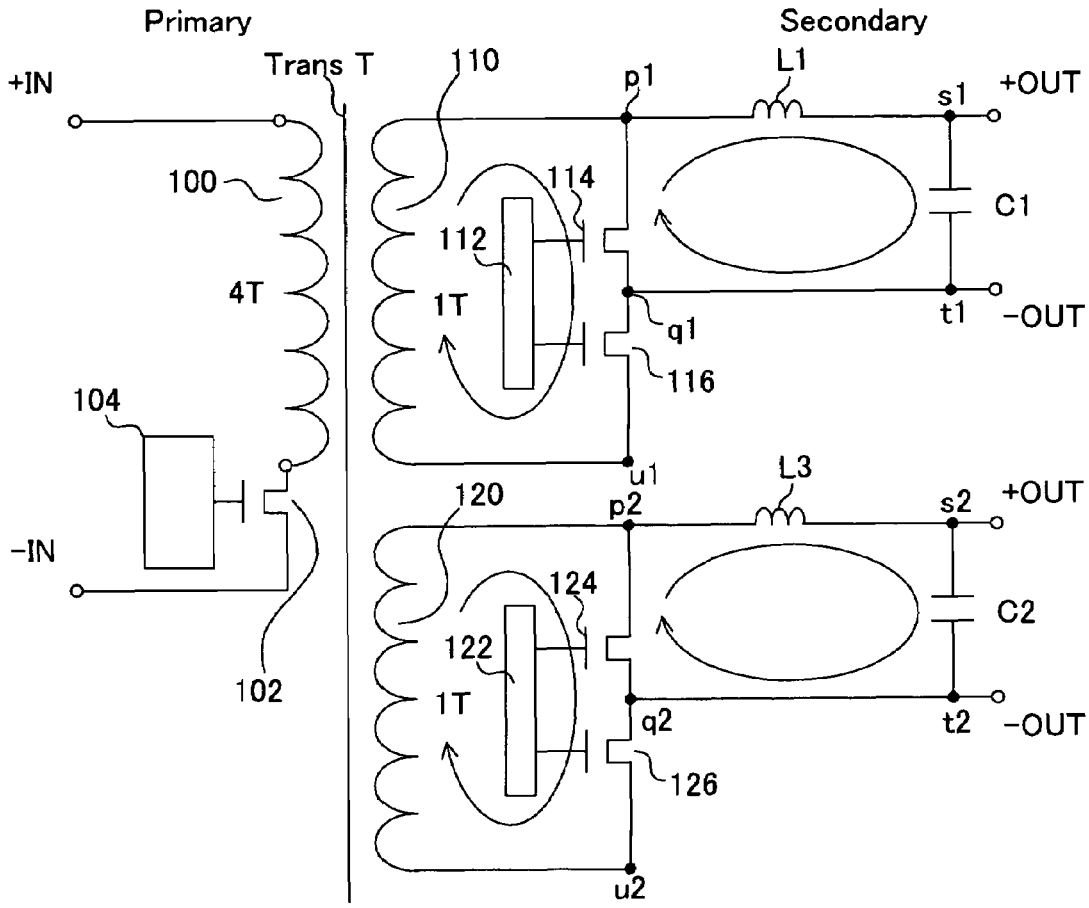
FIG. 9 PRIOR ART
FIG. 9 shows a circuit diagram of a conventional power supply circuit.

For example, as compared to the conventional configuration shown in FIG. 9, the pattern width becomes larger in each layer, and each pattern resistance ra, rc and rg becomes half as large as in the case of the conventional configuration. Accordingly, the power loss can be reduced half as much as in the conventional method. Also, switching noise can be reduced because of the smaller inductance of secondary windings 40, 50.

Figure 10:
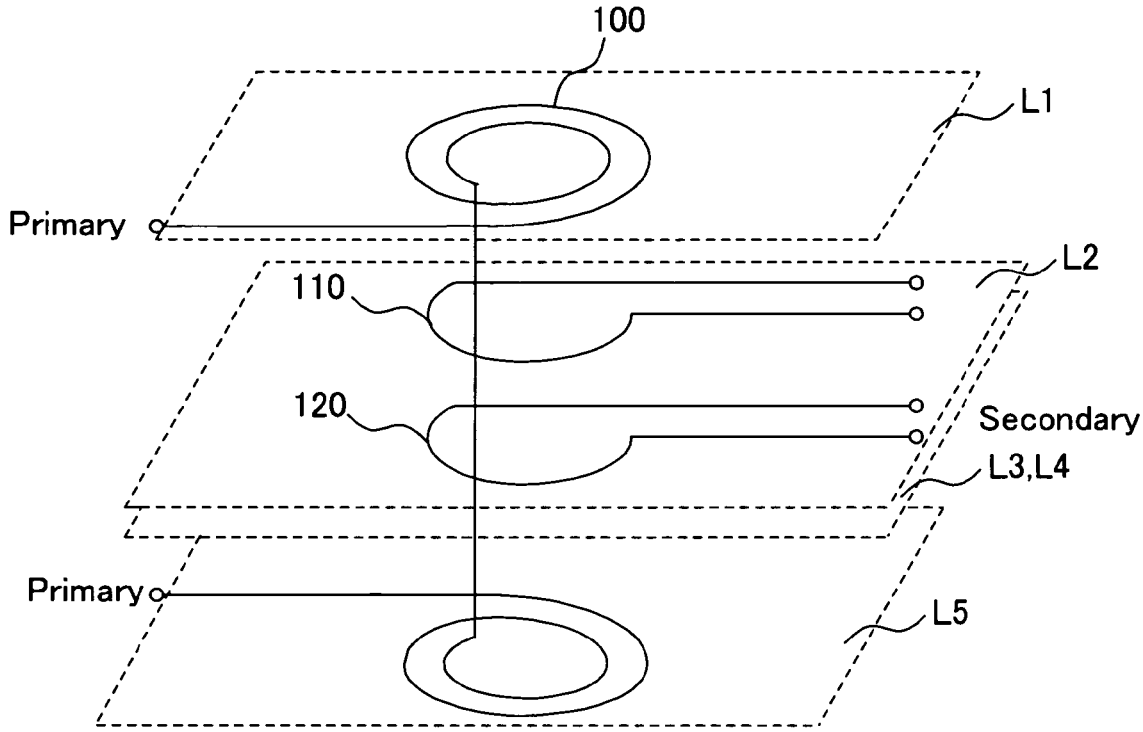
FIG. 10 PRIOR ART
FIG. 10 shows a diagram illustrating a relation between a primary winding and a secondary winding according to a conventional method.
Figure 11:
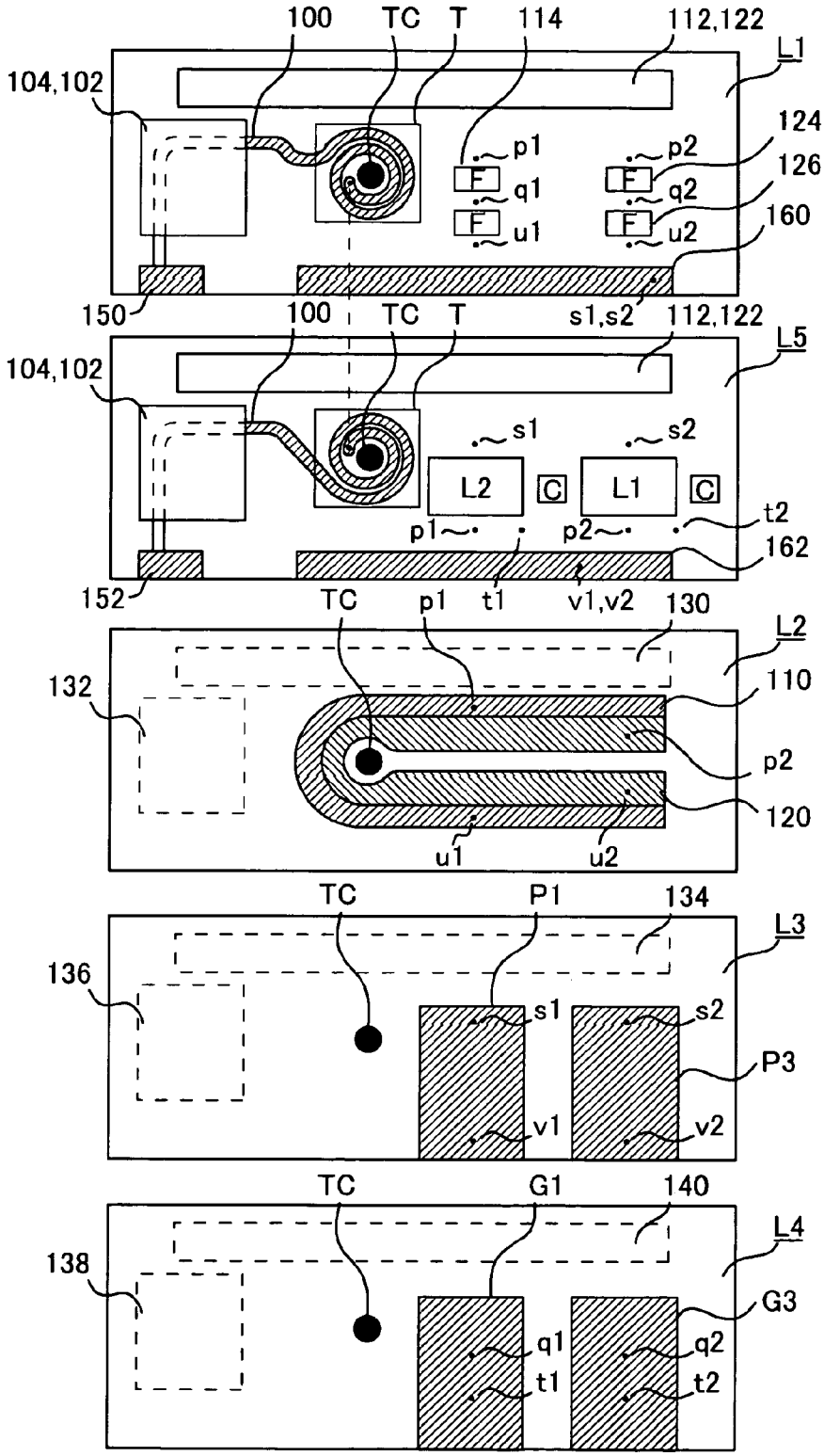
FIG. 11 PRIOR ART
FIG. 11 is an exploded configuration diagram of a conventional power supply module.

As shown in FIG. 10, in the conventional art, the pair of secondary windings is drawn out in an identical direction, and moreover, is disposed on an identical layer. These structures produce narrow secondary windings,. formed of long patterns. Further, because of the extraction in one direction, the output pattern films and ground films have to be located on each half portion of the second and the third inner layers, which disables pattern films from being widened.

In contrast, according to the present invention, as shown in FIG. 1 and FIG. 5, two secondary windings transformer-coupled with the primary winding are drawn out in both directions, and disposed on different layers. Therefore, the secondary windings can be structured of wide and short patterns. Moreover, because of this extraction in both directions, it becomes possible to allocate the output pattern films and the ground films on both sides of the second and the third inner layers. Thus it becomes possible to produce wide pattern films.

With such measures, even when output current becomes large, the power loss becomes half as much as in the conventional method, and higher power efficiency can be obtained. Further, switching noise can be reduced because of the reduced inductance. Moreover, the module can be structured without increasing the size.

[Electronic Apparatus]

Figure 7:
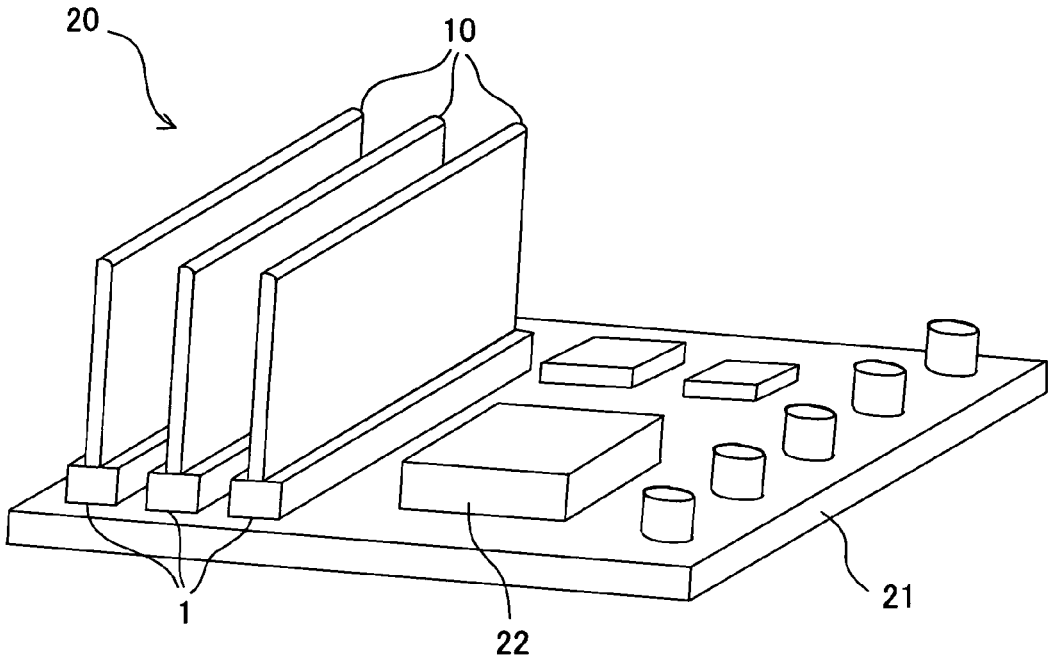
FIG. 7 shows a configuration diagram of a CPU board, on which the power supply module shown in FIG. 1 is mounted.
Figure 8:
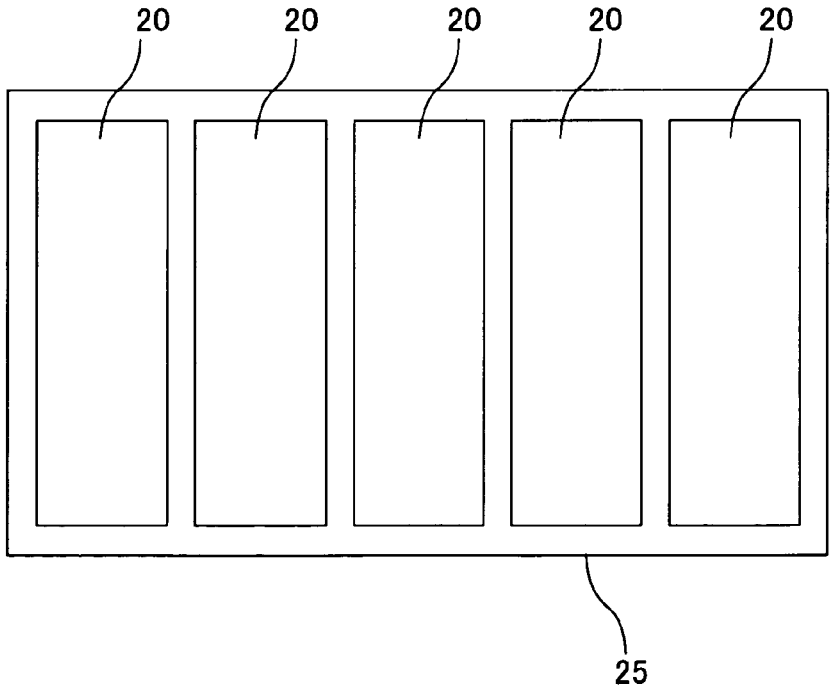
FIG. 8 shows a configuration diagram of an electronic apparatus, in which the CPU board shown in FIG. 7 is accommodated.

FIG. 7 is a configuration diagram of a board for an electronic apparatus, on which a power supply module in accordance with the present invention is mounted. FIG. 8 is a configuration diagram of an electronic apparatus, in which the board for the electronic apparatus shown in FIG. 7 is accommodated.

As shown in FIG. 7, a large number of LSIs 22 including a CPU are mounted on a printed circuit board 21 of a CPU board 20. A power connector 1 is provided on this board 21, and the power supply module 10 having been explained in FIG. 1 through FIG. 6 is connected to the power connector 1. In this example, a plurality of (three) power supply modules 10 are mounted, because high-speed CPUs requiring large current are used.

As shown in FIG. 8, a required number of CPU-boards 20 are vertically disposed in parallel on a rack 25, thereby constituting a server. In such a way, the power supply module 10 may be used for a distributed power supply, because of a miniaturized structure. Further, because of the improved power efficiency as described earlier, it becomes possible to reduce power consumption of the electronic apparatus having high-speed CPUs which requires a large current.

[Other Embodiments]

In the aforementioned embodiments of the present invention, two secondary windings are provided, as shown in FIG. 6, and one output is produced therefrom. Instead, it may also be possible to have two outputs. Similarly, it may be possible to increase the number of secondary windings, to three or more, by increasing the number of layers in the module.

As the embodiments of the present invention have been described, it may be possible to conceive a variety of modifications within the scope of the present invention. The foregoing description of the embodiments is not intended to limit the invention to the particular details of the examples illustrated. All features and advantages of the invention which fall within the scope of the invention are covered by the appended claims.

As described above, according to the present invention, a pair of secondary windings transformer-coupled with the primary winding are drawn out in both directions, and disposed on-different layers. Therefore, the secondary. windings can be structured of wide and short patterns. Moreover, because of this extraction in both directions, it becomes possible to allocate the output pattern films and the ground films on both sides of the second and the third inner layers. Thus it becomes possible to produce wide pattern films.

With such measures, even when output current becomes large, the power loss becomes half as much as in the conventional method, and higher power efficiency can be obtained. Further, switching noise can be reduced because of the reduced inductance. Moreover, the module can be structured without increasing the size.

What is claimed is:

1. A power supply module having a primary winding coupled with secondary windings by a transformer, and comprising:

a component-mounting layer on which the primary winding, the transformer, a primary side circuit, and a secondary side circuit are mounted;

a first inner layer on which a pattern of a first secondary winding of the secondary windings drawn out in one direction is formed; and a second inner layer on which a pattern of a second secondary winding of the secondary windings drawn out in the other direction is formed, wherein an output pattern film of the second secondary winding is formed on the first inner layer, and an output pattern film of the first secondary winding is formed on the second inner layer.

2. The power supply module according to claim 1, further comprising:

an input terminal connected to the primary winding; and a pair of output terminals connected to the output pattern film of the first secondary winding and the output pattern film of the second secondary winding, respectively.

3. The power supply module according to claim 1, wherein, on the component-mounting layer, a secondary side circuit of the first secondary winding is disposed on one side of the transformer, and a secondary side circuit of the second secondary winding is disposed on the other side of the transformer.

4. The power supply module according to claim 3, wherein the component-mounting layer comprises:

a first component-mounting layer having a rectifier circuit for the secondary side circuit of the first secondary winding, being disposed on one side of the transformer, and a rectifier circuit for the secondary side circuit of the second secondary winding, being disposed on the other side of the transformer; and a second component-mounting layer having a smoothing circuit for the secondary side circuit of the first secondary winding, being disposed on one side of the transformer, and a smoothing circuit for the secondary side circuit of the second secondary winding, being disposed on the other side of the transformer.

5. The power supply module according to claim 4, wherein the rectifier circuit for the secondary side circuit mounted on the component-mounting layer comprises:

a switching element; and a switching control circuit.

6. The power supply module according to claim 1, further comprising:

a third inner layer on which a pair of ground films for the first and the second secondary windings is formed.

7. The power supply module according to claim 6, wherein the secondary side circuit mounted on the component-mounting layer, the first secondary winding and the output pattern film formed on the first inner layer, the second secondary winding and the output pattern film formed on the second inner layer, and the pair of ground films formed on the third inner layer are connected through vias.

8. An electronic apparatus comprising:

a power supply module having a primary winding coupled with a secondary winding by a transformer, and an electronic device operated by power supplied from the power supply module, wherein the power supply module comprises:

a component-mounting layer on which the primary winding, the transformer, a primary side circuit, and a secondary side circuit are mounted;

a first inner layer on which a pattern of a first secondary winding of the secondary windings drawn out in one direction is formed; and a second inner layer on which a pattern of a second secondary winding of the secondary windings drawn out in the other direction is formed, and wherein an output pattern film of the second secondary winding is formed on the first inner layer, and an output pattern film of the first secondary winding is formed on the second inner layer.

9. The electronic apparatus according to claim 8, wherein the power supply module further comprises:

a third inner layer on which a pair of ground films for the first and the second secondary winding is formed.

10. The electronic apparatus according to claim 9, wherein the power supply module further has via connections of the secondary side circuit mounted on the component-mounting layer, the first secondary winding and the output pattern film formed on the first inner layer, the second secondary winding and the output pattern film formed on the second inner layer, and the pair of ground films formed on the third inner layer.

11. The electronic apparatus according to claim 8, wherein the power supply module further comprises:

a substrate for mounting the electronic device; and a connector connecting the power supply module to the substrate.

12. The electronic apparatus according to claim 8, wherein the power supply module further comprises:

an input terminal connected to the primary winding; and an output terminal connected to the output pattern film.

13. The electronic apparatus according to claim 8, wherein the component-mounting layer of the power supply module further comprises:

a secondary side circuit of the first secondary winding, being disposed on one side of the transformer, and a secondary side circuit of the second secondary winding, being disposed on the other side of the transformer.

14. The electronic apparatus according to claim 13, wherein the component-mounting layer of the power supply module comprises:

a first component-mounting layer having a rectifier circuit for the secondary side circuit of the first secondary winding, being disposed on one side of the transformer, and a rectifier circuit for the secondary side circuit of the second secondary winding, being disposed on the other side of the transformer; and a second component-mounting layer having a smoothing circuit for the secondary side circuit of the first secondary winding, being disposed on one side of the transformer, and a smoothing circuit for the secondary side circuit of the second secondary winding, being disposed on the other side of the transformer.

15. The electronic apparatus according to claim 14, wherein the rectifier circuit for the secondary side circuit mounted on the component-mounting layer of the power supply module comprises:

a switching element; and a switching control circuit.

* * * * *

UNITED STATES PATENT AND TRADEMARK OFFICE

CERTIFICATE OF CORRECTION

PATENT NO. : 7,132,921 B2
APPLICATION NO. : 10/773153
DATED : November 7, 2006
INVENTOR(S) : Susumu Eguchi et al.

It is certified that error appears in the above-identified patent and that said Letters Patent is hereby corrected as shown below:

Column 9, Line 47, after “transformer” change “,” to --;--.

Signed and Sealed this

Sixth Day of March, 2007

JON W. DUDAS
*Director of the United States Patent and Trademark Office*